US010306358B2

(12) United States Patent
Faller et al.

(10) Patent No.: US 10,306,358 B2
(45) Date of Patent: May 28, 2019

(54) SOUND SYSTEM

(71) Applicant: Fraunhofer-Gesellschaft zur Foerderung der angewandten Forschung e.V., Munich (DE)

(72) Inventors: Christof Faller, Greifensee (CH); Markus Schmidt, Loerrach (DE); Andreas Walther, Feucht (DE); Christian Borss, Erlangen (DE); Ville Saari, Nuremberg (DE); Philipp Goetz, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/795,527

(22) Filed: Oct. 27, 2017

(65) Prior Publication Data

US 2018/0103316 A1 Apr. 12, 2018

Related U.S. Application Data

(63) Continuation of application No. PCT/EP2016/058646, filed on Apr. 19, 2016.

(30) Foreign Application Priority Data

Apr. 27, 2015 (EP) ..... 15165250

(51) Int. Cl.
*H04R 1/40* (2006.01)
*H04R 5/02* (2006.01)
(Continued)

(52) U.S. Cl.
CPC ..... *H04R 1/403* (2013.01); *H04R 5/02* (2013.01); *H04R 5/04* (2013.01); *H04S 5/005* (2013.01);
(Continued)

(58) Field of Classification Search
CPC ..... H04R 3/12; H04R 5/02; H04R 2499/15; H04R 2430/03; G10L 21/0208; H04S 2420/07
(Continued)

(56) References Cited

U.S. PATENT DOCUMENTS 5,291,556 A 3/1994 Gale et al.
5,809,150 A 9/1998 Eberbach
(Continued)

FOREIGN PATENT DOCUMENTS

CN 102196334 A 9/2011
EP 2099238 A1 9/2009
(Continued)

*Primary Examiner* — Alexander Jamal
(74) *Attorney, Agent, or Firm* — Perkins Coie LLP; Michael A. Glenn

(57) ABSTRACT

A calculation unit for a sound system includes an input terminal, a processor and an output terminal. The input terminal has the purpose to receive an audio stream to be reproduced using the sound system. The output terminal has the purpose to control the sound system based on a first and a second plurality of individual audio signals. The processor is configured to calculate the first plurality of audio signals such that beamforming is performed by the array and to calculate the second plurality of individual audio signals to perform, using the sound system, direct sound suppression such that sound is canceled towards a listening direction. Furthermore, the processor filters at least the second plurality using a second passband characteristic including a second portion of the entire frequency range.

23 Claims, 11 Drawing Sheets

(51) Int. Cl.
*H04R 5/04* (2006.01)
*H04S 5/00* (2006.01)

(52) U.S. Cl.
CPC .... *H04R 2201/403* (2013.01); *H04R 2430/03* (2013.01); *H04R 2430/23* (2013.01); *H04R 2499/15* (2013.01); *H04S 2420/07* (2013.01)

(58) Field of Classification Search
USPC ..... 381/13, 300, 306, 97, 94.3
See application file for complete search history.

(56) References Cited

U.S. PATENT DOCUMENTS

| | | | | |
|---|---|---|---|---|
| 5,953,432 | A | 9/1999 | Yanagawa et al. | |
| 8,150,068 | B2 | 4/2012 | Takumai et al. | |
| 8,189,795 | B2 | 5/2012 | Konagai et al. | |
| 8,452,019 | B1 | 5/2013 | Fomin et al. | |
| 8,477,951 | B2 | 7/2013 | Jung et al. | |
| 2004/0151325 | A1* | 8/2004 | Hooley | F41H 13/0081 381/18 |
| 2005/0089182 | A1 | 4/2005 | Troughton et al. | |
| 2007/0286427 | A1 | 12/2007 | Jung et al. | |
| 2010/0142733 | A1* | 6/2010 | Choi | H04R 3/12 381/300 |
| 2011/0216925 | A1 | 9/2011 | Riggs et al. | |
| 2012/0020480 | A1 | 1/2012 | Visser et al. | |
| 2013/0070944 | A1* | 3/2013 | Lee | H04R 5/02 381/306 |

FOREIGN PATENT DOCUMENTS

| | | | |
|---|---|---|---|
| EP | 2426949 | A2 | 3/2012 |
| JP | 2005101902 | A | 4/2005 |
| JP | 2013522996 | A | 6/2013 |
| WO | 2011114252 | A1 | 9/2011 |
| WO | 2011161567 | A1 | 12/2011 |
| WO | 2013040738 | A1 | 3/2013 |
| WO | 2014107714 | A1 | 7/2014 |

* cited by examiner

SOUND SYSTEM

CROSS-REFERENCE TO RELATED APPLICATIONS

This application is a continuation of copending International Application No. PCT/EP2016/058646, filed Apr. 19, 2016, which claims priority from European Application No. EP 15165250.0, filed Apr. 27, 2015, which are each incorporated herein in its entirety by this reference thereto.

Embodiments of the present invention refer to a calculation unit for a sound system, to a corresponding method for calculating a sound reproduction and to a sound system.

BACKGROUND OF THE INVENTION

For sound reproduction, especially movie sound reproduction, there are different kinds of systems which differ with regard to their complexity and reproduction quality. The reference for movie sound is the cinema. Cinemas provide multi-channel surround sound, with loudspeakers installed not only in front at the screen, but additionally on the sides and rear. The side and rear loudspeakers enable an enveloping surround sound.

For the home, so-called home cinema systems usually feature five loudspeakers and a subwoofer. Three of the loudspeakers are in front and two are on the side/rear. The side/rear loudspeakers often pose a problem: People will often rather be without them to avoid not only visually distracting loudspeakers in the rear, but also the corresponding cabling.

An alternative to home cinema systems are soundbars. Many variations of soundbars exist on the market. The most sophisticated soundbars not only enhance the sound spatially, but form beams to project the sound signals to the side/rear, with the help of reflecting walls. In this case, true surround with a sound perceivable from side/rear is reproduced without surround speakers.

A soundbar projecting the sound channels to the side/rear comprises a loudspeaker array which projects at least one channel to the side/rear by means of beamforming, e.g. a delay and sum beamformer. A limitation of delay and sum beamformers is that the aperture of the array has to be at least of the size of order of magnitude of the wavelength of a sound frequency to be emitted. If the array is small compared to the wavelength, no directive beam can be formed.

For example, when a 1.2 m long soundbar emits sound at 200 Hz (wavelength 1.7 m), no beam with high directivity can be formed. Consequently, soundbars can only effectively project sound to side/rear at medium to high frequencies. Low frequencies will be reproduced from the front, since projection over walls involves very high directivity (such that only a very low level of sound is reaching the listeners directly, while most of the sound is reaching the listeners via a wall reflected beam).

The U.S. Pat. No. 8,477,951 discloses a loudspeaker array reproduction system that improves the stereo effect of middle and low frequency signals through the use of a psychoacoustic model. The input signal is split, and one part for which beamforming is not performed, is reproduced using virtualization techniques based on HRTF processing, the other part is processed using beamforming techniques. Further audio systems comprising a plurality of channels which feature a loudspeaker array are disclosed by the US Patent Application US 2005/0089182 and the U.S. Pat. No. 5,953,432.

The U.S. Pat. No. 8,189,795 discloses a processing for use of the loudspeaker array, where high and low frequency bands are reproduced in different ways. While the high-frequency part is played back using beamforming techniques, the low frequency part is further divided into correlated and uncorrelated parts, which are then played back by further non-arrayed loudspeakers with different directivity.

The U.S. Pat. No. 8,150,068 discloses an array playback system for surround sound input, that makes use of a frequency division into high and low frequency parts. The higher frequency is reproduced using the loudspeaker array for beamforming and utilizing the wall reflections. The lower frequency part of the different input channels are summed into signals which are output over one or more woofer speakers.

All above teachings have the drawback of high complexity and/or limited quality of surround reproduction. Therefore, there is a need for an improved approach.

SUMMARY

According to an embodiment, a calculation unit for a sound system including an array having a plurality of transducers may have: input means for receiving an audio stream to be reproduced using the sound system and having a frequency range; a processor; and output means for controlling the sound system, wherein the processor is configured to calculate a first plurality of individual audio signals for the transducers of the array such that beamforming is performed by the array, wherein the first plurality of individual audio signals includes a frequency range corresponding to a first portion of the frequency range of the audio stream, wherein the processor is configured to calculate a second plurality of individual audio signals for the transducers of the sound system to perform, using the sound system, direct sound suppression such that sound is canceled towards a listening direction, wherein the processor is configured to filter the second plurality of individual audio signals using a second passband characteristic including a second portion of the frequency range of the audio stream, wherein the second portion differs from the first portion; wherein the beamforming performed via the first plurality of individual audio signals is performed by using at least three audio signals such that at least three transducers are controlled.

According to another embodiment, a sound system may have: the processor and an array having the plurality of transducers.

According to another embodiment, a method for calculating a sound reproduction for a sound system including an array having a plurality of transducers may have the steps of: receiving an audio stream to be reproduced using the array and having a frequency range; calculating a first plurality of individual audio signals for the transducers of the array such that beamforming is performed via the array, wherein the first plurality of individual audio signals includes a frequency range corresponding to a first portion of the frequency range of the audio stream; calculating a second plurality of individual audio signals for the transducers of the sound system to perform, using the sound system, direct sound suppression such that sound is canceled towards a listening direction; filtering the second plurality of individual audio signals using a second passband characteristic including a second portion of the frequency range of the audio stream, wherein the second portion differs from the first portion; and outputting the individual audio signals of the first and second plurality in order to control the sound system.

According to another embodiment, a non-transitory digital storage medium may have a computer program stored thereon to perform the method for calculating a sound reproduction for a sound system including an array having a plurality of transducers, which method may have the steps of: receiving an audio stream to be reproduced using the array and having a frequency range; calculating a first plurality of individual audio signals for the transducers of the array such that beamforming is performed via the array, wherein the first plurality of individual audio signals includes a frequency range corresponding to a first portion of the frequency range of the audio stream; calculating a second plurality of individual audio signals for the transducers of the sound system to perform, using the sound system, direct sound suppression such that sound is canceled towards a listening direction; filtering the second plurality of individual audio signals using a second passband characteristic including a second portion of the frequency range of the audio stream, wherein the second portion differs from the first portion; and outputting the individual audio signals of the first and second plurality in order to control the sound system, when said computer program is run by a computer.

According to another embodiment, a calculation unit for a sound system including an array having a plurality of transducers may have: input means for receiving an audio stream to be reproduced using the sound system and having a frequency range; a processor; and output means for controlling the sound system, wherein the processor is configured to calculate a first plurality of individual audio signals for the transducers of the array such that beamforming is performed by the array, wherein the first plurality of individual audio signals includes a frequency range corresponding to a first portion of the frequency range of the audio stream, wherein the processor is configured to calculate a second plurality of individual audio signals for the transducers of the sound system to perform, using the sound system, direct sound suppression such that sound is canceled towards a listening direction, wherein the processor is configured to filter the second plurality of individual audio signals using a second passband characteristic including a second portion of the frequency range of the audio stream, wherein the second portion differs from the first portion; wherein the direct sound suppression is performed using sound cancelation, wherein the sound cancelation corrects second plurality of individual audio signals within the second portion of the frequency range using beamforming performed via the first plurality of individual audio signals.

According to another embodiment, a calculation unit for a sound system including an array having a plurality of transducers may have: input means for receiving an audio stream to be reproduced using the sound system and having a frequency range; a processor; and output means for controlling the sound system, wherein the processor is configured to calculate a first plurality of individual audio signals for the transducers of the array such that beamforming is performed by the array, wherein the first plurality of individual audio signals includes a frequency range corresponding to a first portion of the frequency range of the audio stream, wherein the processor is configured to calculate a second plurality of individual audio signals for the transducers of the sound system to perform, using the sound system, direct sound suppression such that sound is canceled towards a listening direction, wherein the processor is configured to filter the second plurality of individual audio signals using a second passband characteristic including a second portion of the frequency range of the audio stream, wherein the second portion differs from the first portion; wherein the beamforming performed via the first plurality of individual audio signals is performed by using at least three audio signals such that at least three transducers are controlled, wherein second portion is a subset of the first portion.

An embodiment of the invention provides a calculation unit for a sound system which comprises at least an array having a plurality of transducers. The calculation unit comprises input means for receiving an audio stream to be reproduced using the array, a processor and output means for controlling the sound system/the array. The audio stream has a certain frequency range, e.g. from 20 Hz to 20 kHz. The processor is configured to calculate a first plurality of individual audio signals for the transducers of the array such that beamforming is performed by the array.

Furthermore, the processor is configured to calculate the second plurality of individual audio signals for the transducers of the sound system to perform, using the transducers, so-called direct sound suppression such that sound is canceled towards a listening direction. This may be realized by a technique called dipoling (e.g. applying phase shifted signals to transducers arranged spaced apart from each other) and/or by a technique called sound cancelation (e.g. comprising a manipulation or correction of the beamforming), performed by the sound system. Here, the first plurality of individual audio signals comprises a frequency range corresponding to a first portion of the entire frequency range of the audio stream (e.g. a frequency range from 400 Hz to 2000 Hz or from 500 Hz to 5000 Hz or the entire frequency range of the audio stream). The processor filters the second plurality of individual audio signals using a second passband characteristic (e.g. from 100 Hz to 500 Hz or from 200 Hz to 400 Hz), i.e., the second passband characteristic comprises a second portion of the entire frequency range of the audio stream. In general, the second portion differs from the first portion.

The teachings disclosed herein are based on the knowledge that the quality of surround effects generated using beamforming varies over the entire frequency range. In detail, the beamforming is limited within certain frequencies; e.g. at low frequencies, beams cannot be projected via walls to the listener, they will reach the listeners with substantial level directly. Therefore, according to the teachings disclosed herein, this certain (problematic) frequencies are reproduced by another technique, called direct sound suppression comprising dipoling, or alternatively by using sound cancelation within these (problematic) frequencies, both enabling to generate a radiation pattern of the playback device having a sound minimum (at least within some frequencies) in the direction of a listener or a listening area.

Dipoling is a technique according to which the sound is canceled in a certain area or direction by using at least two transducers that are driven by signals with differing phase. Sound cancelation is a technique which may comprise a further beamforming reproduction performed in that way that the (first) beamforming within the problematic frequencies is corrected. The further beamforming reproduction comprises especially the (problematic) frequencies for which the reproduction by the first beamforming performance does not suffice. The sound cancelation and/or the dipoling enable to improve the reproduction, especially within the problematic frequencies and, thus, the entire reproduction without increasing the complexity, since the two techniques are applicable by use of the same soundbar.

According to an aspect of the invention the sound cancelation is used to perform sound cancelation of the frequencies and in the area to which the sound signal has misleadingly been emitted by the first beamforming reproduction. For example, low frequencies, which are typically emitted by a soundbar performing beamforming in a direct manner can be canceled in this area due to a second beam.

According to another aspect, these frequencies, e.g. low frequencies, can be reproduced using dipoling, e.g. via the transducers of the soundbar which are arranged furthest from each other such that the sound is emitted in the two directions. Here, it may be, according to embodiments, beneficial to limit the frequency range in which beamforming is preformed (by means of filtering). Consequently, the transducers of the soundbar perform beamforming within a first frequency range which does not comprise problematic frequencies and uses at least two transducers for outputting the problematic, e.g. lower frequencies in a dipole manner.

According to an embodiment, the dipoling is performed by providing at least two individual audio signals of the second plurality of individual audio signals for two different transducers or two different groups of transducers in a phase-shifted manner, for example, phase-shifted by 180°.

According to a further embodiment, a third bandwidth, e.g. a bandwidth having a higher frequency than the first portion of the frequency range, may be reproduced using the above described dipoling techniques.

It should be noted that the first plurality of individual audio signals and the second plurality of individual audio signals may be used for controlling different transducers. According to an advantageous embodiment, the first plurality of individual audio signals may be used to control the entire array, wherein the second plurality is used to control just a (real) subset, e.g. two transducers of the arrays. Here, it is, especially with respect to the reproduction of low frequencies in a dipole manner, beneficial to use or to control the transducers which are arranged furthest from each other.

According to an embodiment, the calculation of the first plurality of individual audio signals $x_i$ may be based on the formula $$x_i(t)=HPF\{s(t+\tau_i)\},$$

or the formula $$x_i(t)=HPF\{s(t+*\tau-N*\tau)\},$$

wherein HPF complies with the first passband characteristic, $\tau/\tau_i$ with a delay and N with the number of transducers of the array, and wherein the calculation of the second plurality of individual audio signals $x_i$ and $x_N$ is based on the formula $$x_i(t)=LPF\{s(t)\}$$

$$x_N(t)=-LPF\{s(t)\},$$

wherein LPF complies with the second passband characteristic.

A further embodiment provides a sound system comprising an above discussed calculator and the corresponding array. The array may, according to further embodiments, have separate transducers, which may be used for dipoling, i.e. are controlled using the second plurality of individual audio signals.

A further embodiment provides the corresponding method for calculating a sound reproduction for a sound system.

BRIEF DESCRIPTION OF THE DRAWINGS

Embodiments of the present invention will be detailed subsequently referring to the appended drawings, in which.

DETAILED DESCRIPTION OF THE INVENTION

Embodiments of the present invention will be discussed in detail below referring to the figures. Reference numbers are provided to objects having the same or an identical function. Therefore, the description thereof is interchangeable or mutually applicable.

Figure 1:
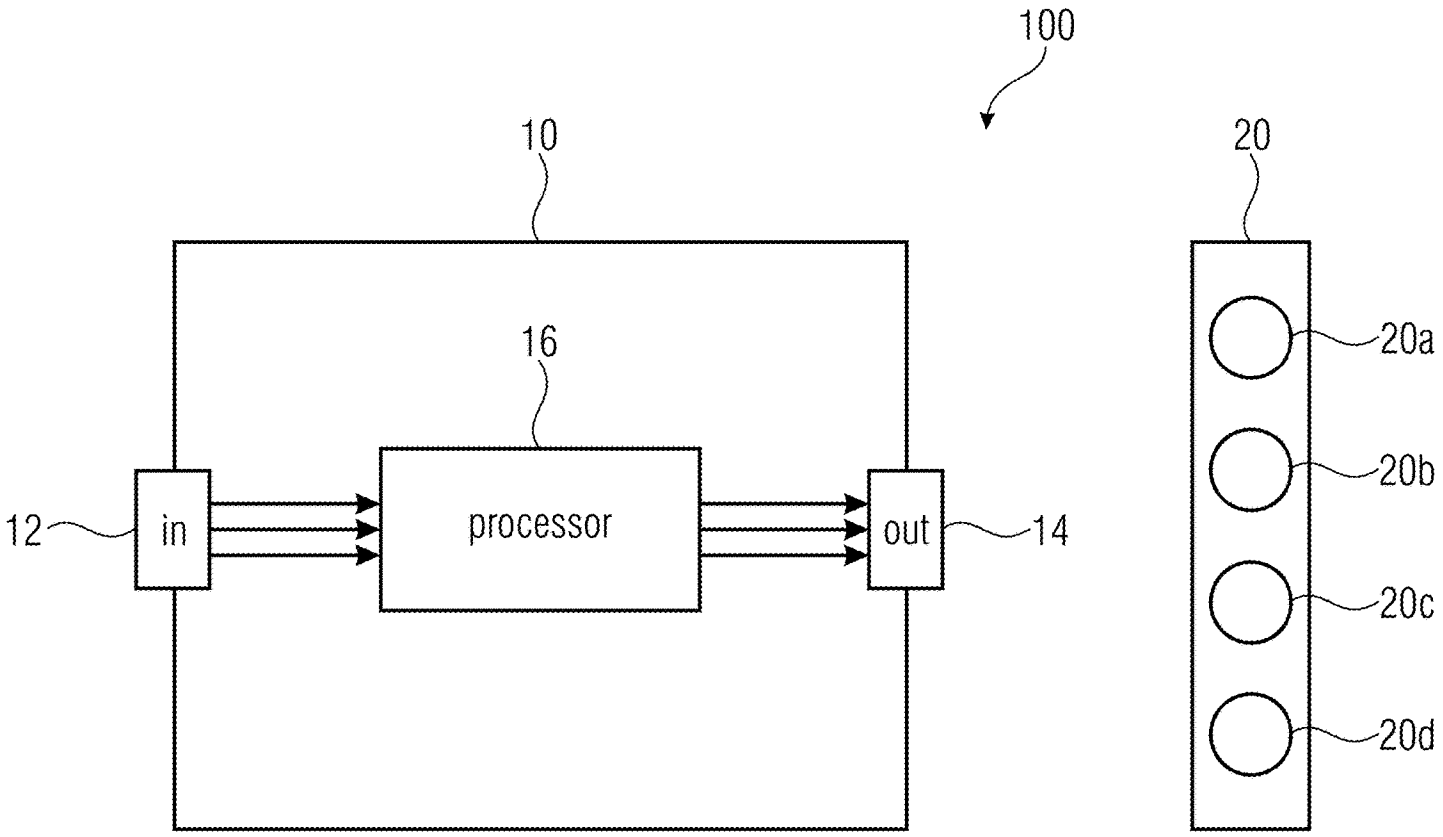
FIG. 1 shows a schematic block diagram of a sound system with calculation unit according to a first embodiment.

FIG. 1 shows a calculation unit 10 for a sound system 100, here a soundbar system. In this embodiment, the sound system 100 comprises at least an array 20 (soundbar) having a plurality of transducers 20*a* to 20*d*. The calculation unit 10 comprises input means 12, a processor 16 and output means 14 for controlling the sound system 100.

An audio stream (e.g. mono/stereo signals or a multichannel audio stream like common surround sound data or wave field synthesis data) is received via the input means 12, processed by the processor 16 and, dependent on the processing, at least a first plurality of individual audio signals and a second plurality of individual audio signals are output via the output means 14 (e.g. amplification stages) in order to control the transducers 20*a* to 20*d* of the sound system 20.

The processor 16 performs a calculation of a first beamforming reproduction (cf. first plurality of individual audio signals). This first beamforming reproduction enables good surround effects in a limited portion of the entire frequency range (e.g. comprising medium frequencies from 100/200 Hz to 400/600 Hz). Particularly in some portions, which will be referred to as second portion or "problematic" portion, the reproduction is poor. Therefore, the processor calculates a second plurality of individual audio signals enabling a correct (beamforming) reproduction within this second portion at least at the listening position. Note, that the first plurality of individual audio signals and the second plurality of individual audio signals may be used to control the same transducers, wherein they are different with regard to the comprised frequency ranges.

For example: Typically low frequency ranges are the problematic frequency ranges. Therefore, the second portion of the entire frequency range typically comprises these frequencies, e.g. below 200 Hz or 100 Hz. Dependent on the reproduction technique of the second portion; the first portion may comprise the frequencies above the second portion or may comprise the frequencies of the second portion and the frequencies above the second portion. In order to enable this frequency split, the processor 16 may be configured to filter at least a second plurality of individual audio signals or may comprise means for filtering the frequency bands (e.g. a digital filter bank).

The processor 16 corrects the beamforming within the problematic frequency rang using direct sound suppression enabling to cancel or to reduce sound towards a listening direction. The direct sound suppression may be achieved by a technique called beamforming or by a technique called dipoling. Both techniques enabling to improve the reproduction quality within the second (problematic) frequency band will be discussed separately, below. The two techniques have in common, that the sound within the second portion of the frequency range is canceled (or at least reduced in level) towards a listening direction. The listening direction is defined as being directed to a listening point or listening position, wherein listening point means an area defined by the one or more listeners. Note that direct sound suppression towards the listening direction means generating a radiation pattern having local sound reduction or local minimum (e.g. zero) in direction of the listening position.

According to a first technique, the problematic frequency range is not reproduced using the first beamforming reproduction but reproduced based on a so-called dipoling technique on the basis of the second plurality of individual audio signals (via same array 20 is controlled). Dipoling means that the sound signal to be reproduced is generated using at least two transducers which are separated from each other, wherein the transducers are driven by phase-shifted signals, e.g., phase-shifted by 180°. In other words, this means that it is possible to reproduce low frequencies over the array using such a "differential" concept, while a highly directive delay and sum beam at low frequencies is not possible with this array (having a typical size of a soundbar). The usage of the differential concept enables that sound can be reproduced as a figure-of-eight or cardioid by giving signals with different polarity and optional delays to the different loudspeakers 20*a* and 20*d* of the array 20.

Note that a sound signal reproduced in a differential manner, e.g. with a figure-of-eight directivity pattern (dipole), is typically more spacious when compared to sound signals reproduced conventionally. Therefore, very little sound reaches the listeners in front of the soundbar as most sound is emitted towards the left and the right. Thus, the listener will perceive mostly only room reflected sound and he will perceive the sound as very spacious—and not as directly coming from the soundbar. Moreover, this approach has benefits with regard to the effectiveness. The delay and sum projection beams at higher frequencies are more effective when lower frequencies are reproduced as spaciously (e.g., as dipoles) than when low frequencies are reproduced conventionally. This is because low frequencies will not pull the sound image of the surround channels towards the front.

With respect to the choice of the used transducers of the array 20, this means that—according to embodiments—advantageously the dipoling is performed by the transducers which are arranged furthest away from each other, i.e., the outer transducers 20*a* and 20*d*.

According to a second technique the second plurality of individual audio signals are used to perform a so-called sound cancelation. Sound cancelation means that another beamforming reproduction is generated enabling to manipulate the first beamforming just within the problematic frequencies. Thus, the frequency band performed using the second beamforming reproduction has an overlap to the first frequency band within the problematic frequency ranges.

For example, as discussed above, a common problem with low frequencies is that no beam with high directivity can be formed. This leads to a situation that most of the sound within these low frequencies unintendedly reaches the listener from the front, and only a portion reaches the listener in the directed manner, e.g., reflected by the walls. In order to compensate this mismatch it is an option to direct another beam within these low frequencies towards the listener or listening area such that sound cancellation effects occur. Due to the sound cancellation the sound level or, to be more specific, the faulty reproduced sound level, e.g., in front of the soundbar, is reduced or, in general, corrected.

The detailed background in connection with the two applied techniques will be discussed below. The discussion is made starting from a problem analysis.

Figure 2A:
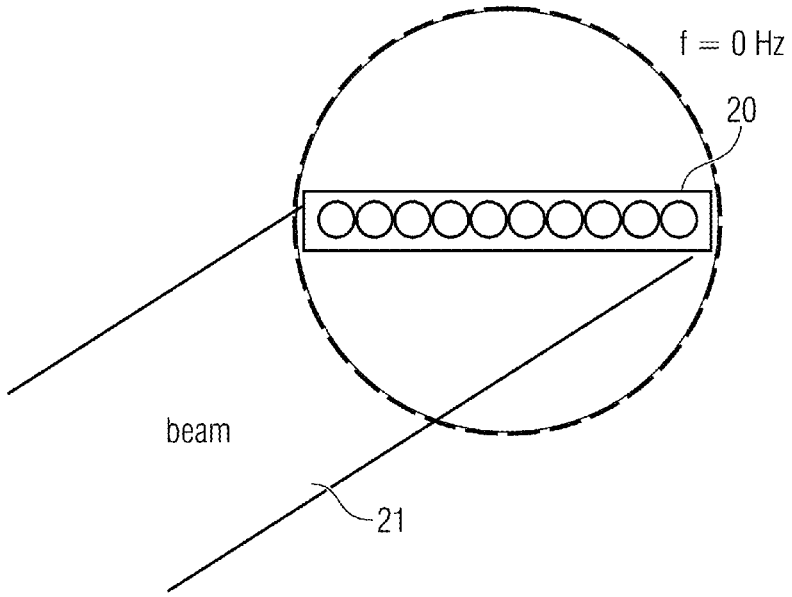
FIGS. 2*a*, 2*b* show a schematic array for illustrating the principle of beamforming and dipoling.

FIG. 2*a* shows the low frequency behavior of the soundbar 20. For low frequencies (for wave lengths at the size or larger than the physical dimensions of the loudspeaker array 20) the radiation pattern approaches the circle, with sound energy disseminated evenly in all directions. No spatial surround sound information can be extracted by the listener as a considerable amount of signal energy reaches the listener's position directly.

The aim of using beamforming for a soundbar 20 is to move signal energy away from the listener's position, such that the main portion of the signal energy no longer impacts directly (since this would be perceived as coming from the front). With a directed beam (cf. beam 21), the main part of the signal energy reaches the listener's position indirectly, e.g., over the walls, and is therefore perceived as coming from a direction in which the beam is steered to or from a direction that does not coincide with the position of the array.

In order to accomplish that the techniques include the reflective surfaces present in the listening room. This is illustrated by FIG. 2*b*.

Figure 2B:
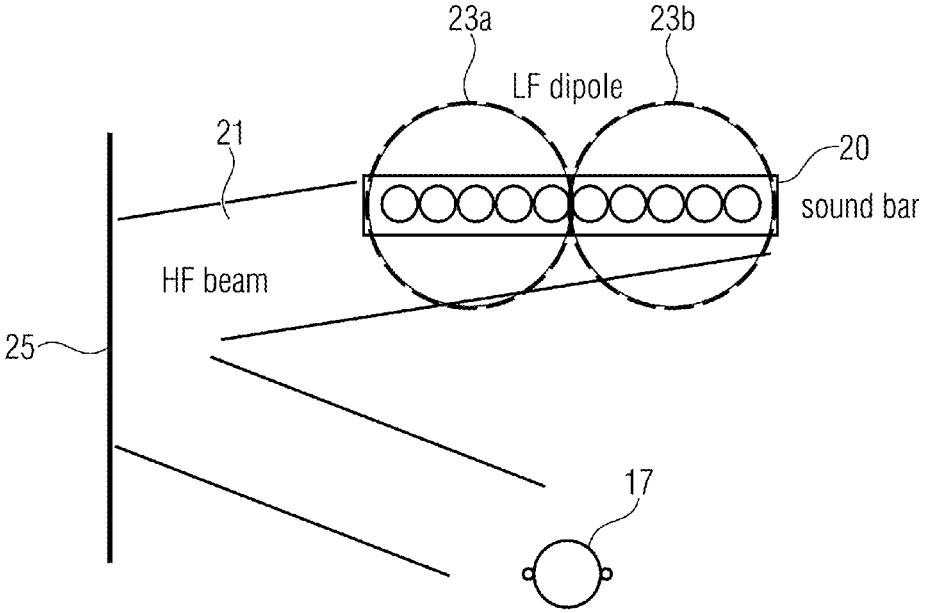

FIG. 2*b* also illustrates the combination of a low frequency dipole 23*a* and 23*b* as well as a high frequency beam 21 both emitted by the sound bar 20. The high frequency content is beamed and directed via a reflected surface 25 towards the listener 27, thus creating spatial perception. The figure-of-eight-pattern of the low frequency dipole 23*a*/23*b* shows how the null of the dipole is directed towards the listener 27, directing the main part of the signal energy towards the sides, thus also creating spatial perception.

With respect to the soundbar 20 it should be noted that the beamforming or, in general, the sound reproduction may be based on the theory of differential sound reproduction. Such differential sound reproduction concepts use reproduction concepts of first (advantageously) or higher order. Note that for sound reproduction having a first order an array having two transducers suffice, wherein for sound reproduction having a second or higher order an array having more than two transducers is typically needed. The usage of sound reproduction of a higher order is predestined for the embodiments according to which a filtering of the individual audio signals is performed.

Figure 3A:
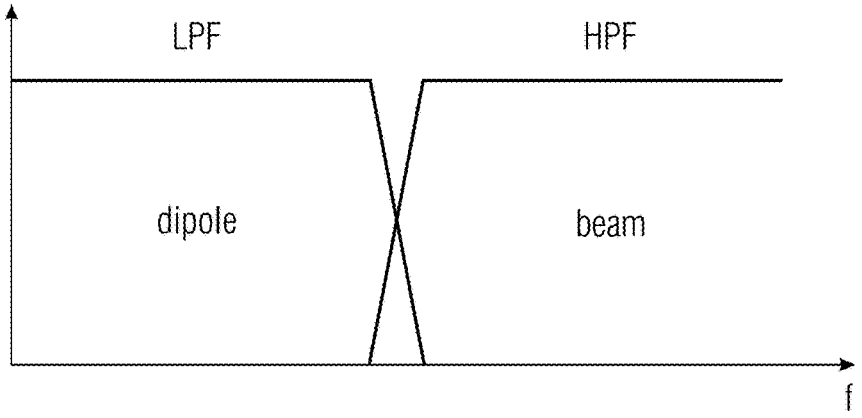
FIG. 3*a* shows a schematic diagram in the frequency view illustrating a combination of beamforming and dipoling.

FIG. 3*a* shows a schematic representation of how, in a setup illustrated by FIG. 2*b*, audio content is distributed with regard to the respective frequency bands to the dipole 23*a*/23*b* and to the beam. As can be seen, the frequency portion reproduced by the dipole 23*a*/23*b* comprises low frequencies, wherein the beam 21 comprises high frequencies. The two respective frequency ranges may have an overlap. In order to separate these two frequency bands, the audio signals for reproducing the dipole are low-passed filtered, wherein the audio signals for reproducing the beam are high-pass filtered.

Figure 3B:
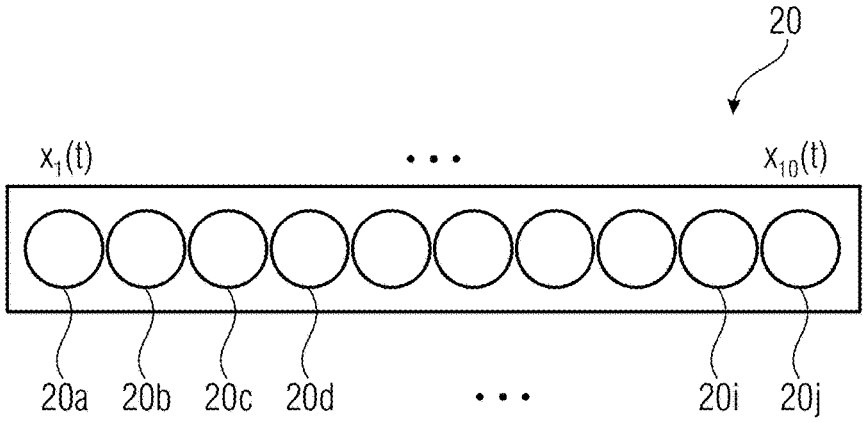
FIG. 3*b* shows an exemplary soundbar used in combination with the embodiment of FIG. 3*a;*

FIG. 3*b* illustrates an example implementation of a loudspeaker array 20 which can be used as soundbar for the above discussed reproduction comprising the two frequency bands. Here, the array comprises ten loudspeakers 20*a* to 20*j* which are arranged in line, wherein a spacing between the singular loudspeakers 20*a* to 20*j* may be of equal distance. It should be noted that the transducers 20*a* to 20*j* may be of the same type or of different types.

The sound signals enabling the above discussed sound reproduction are calculated as follows:

LF Dipole (cf. transducers 20*a* and 20*j*)

$$x_1(t)=LPF\{s(t)\}$$

$$x_{10}(t)=-LPF\{s(t)\} \quad (1)$$

HF Beam (with i=1 . . . 10, all transducers of the array 20)

$$x_i(t)=HPF\{s(t+i*\gamma_10T*\gamma)\} \quad (2)$$

The equation (1) refers to the outermost transducers 20*a* and 20*j* in the array 20 and have the purpose to create the low frequency dipole as illustrated by FIG. 2*b* (cf. reference numbers 23*a*/23*b*). From the same loudspeaker array 20 using all ten drivers 20*a* to 20*j*, the equation 2 shows how the high frequency beam is created (cf. FIG. 2*b*, reference number 21).

Depending on certain factors (e.g., driver spacing in the physical array 20) it may happen that the use of beamforming is not suitable for the whole high frequency region. In this case, a dipole may also be used in certain high frequencies as illustrated by FIGS. 4*a* and 4*b*.

Figure 4A:
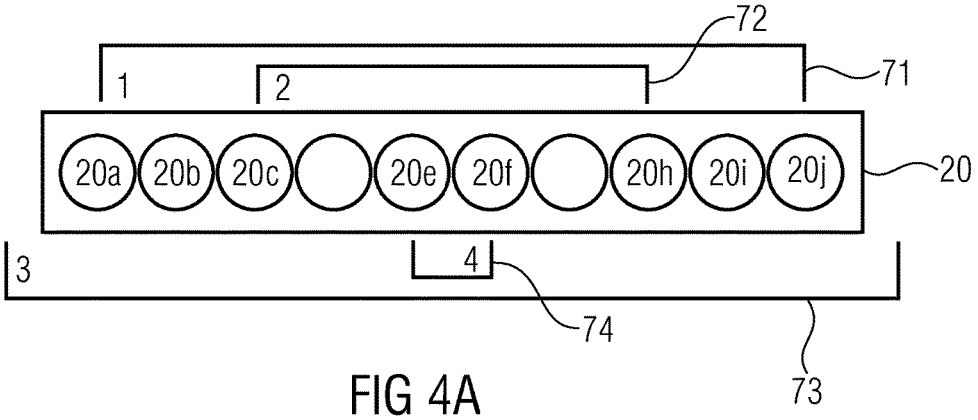
FIGS. 4*a*, 4*b* illustrate an embodiment of an array in which three dipoles and one beam is formed with corresponding frequency range illustration.

FIG. 4*a* shows the array 20, wherein respective transducers 20*a* to 20*j* are grouped to the four groups 71, 72, 73 and 74. The transducers belonging to the four different groups 71, 72, 73 and 74 are used for the reproduction of different frequency bands. The mapping between the groups 71 to 74 and the respective frequency band is illustrated by FIG. 4*b* showing a diagram in which different portions are assigned to the respective groups 71 to 74. Two dipoles are formed by the groups 71 and 72, wherein the group 71 comprises the loudspeakers 20*a* and 20*j* and the group 72 comprises the loudspeakers 20*c* and 20*h*. These two dipoles 71 and 72 are used for the reproduction of low frequency bands. Another dipole 74 is created within a high frequency band. This group of transducers 74 comprises the innermost pair of transducers, i.e., 20*e* and 20*f*. Between the low frequency band reproduced by using the dipole 71 and 72 and the high frequency band (cf. dipole 74) a fourth frequency band (cf. group 73) is arranged for the middle to high frequencies. This frequency band is reproduced using beam forming. Therefore, the group 73 comprises all ten transducers 20*a* to 20*j* of the array.

Figure 4B:
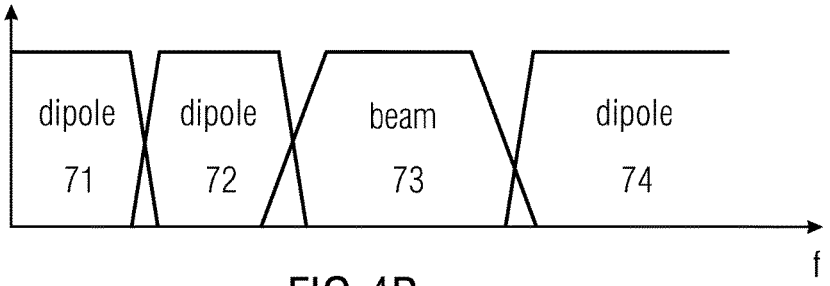
Figure 4C:
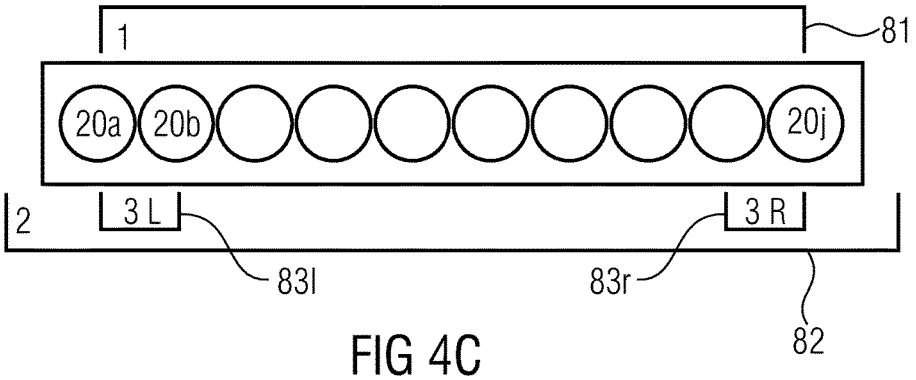
FIGS. 4*c*, 4*d* illustrate an embodiment of an array in which three dipoles and one beam is formed, of which two side orientated dipoles operate in a same frequency range, with corresponding frequency range illustration.
Figure 4D:
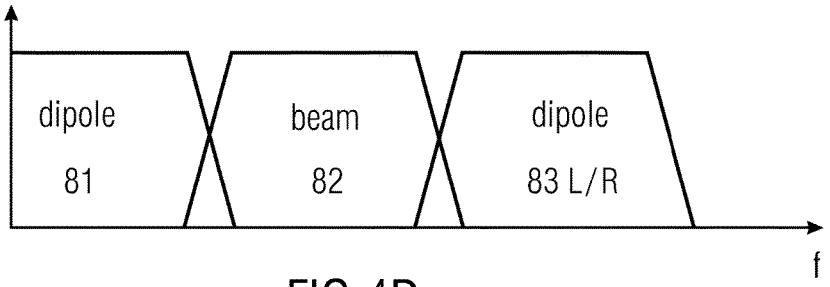

FIGS. 4*c* and 4*d* illustrate a refinement of the embodiment of FIGS. 4*a* and 4*b*. The same array 20 is used. The outermost transducers 20*a* and 20*j* are used to create dipole 81, wherein the group 82 comprising the whole array 20 is used for forming the beam 82. Analogously to the embodiment of FIGS. 4*a* and 4*b* the beam 82 comprises medium and high frequencies, wherein the dipole 81 comprises low frequencies as illustrated by the frequency diagram of FIG. 4*d*. The outermost four transducers, i.e., 20*a*, 20*b*, 20*e* and 20*j* are used to create two pairs of dipoles, here designated 831 and 83*r*. The two dipoles 831 and 83*r* (comprising the transducers 20*a*, 20*b*, 20*e* and 20*j*). These two dipoles 831 and 83*r* operate in the same frequency band comprising high frequencies. The dipole 831 is oriented to the left, wherein the dipole 83*r* is oriented to the right. This enables, for example, the reproduction of stereophonic audio.

Figure 5A:
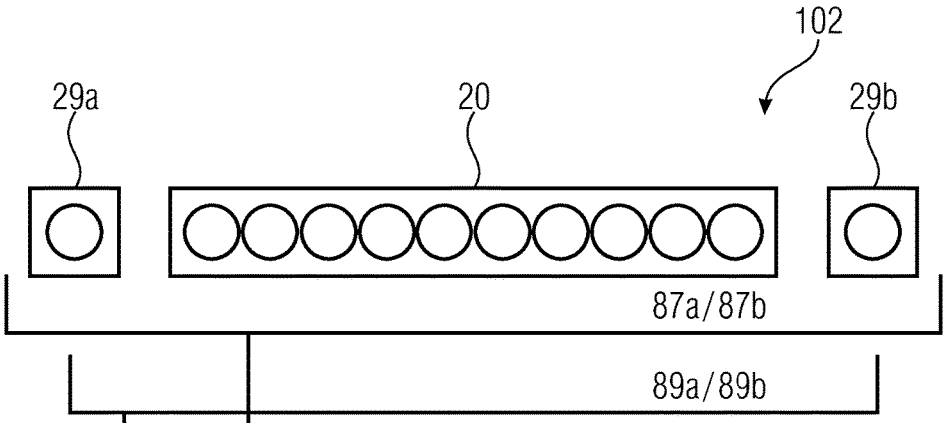
FIGS. 5*a*, 5*b* illustrate an embodiment of an array comprising separate enclosed loudspeakers extending the frequency range for beamforming.
Figure 5B:
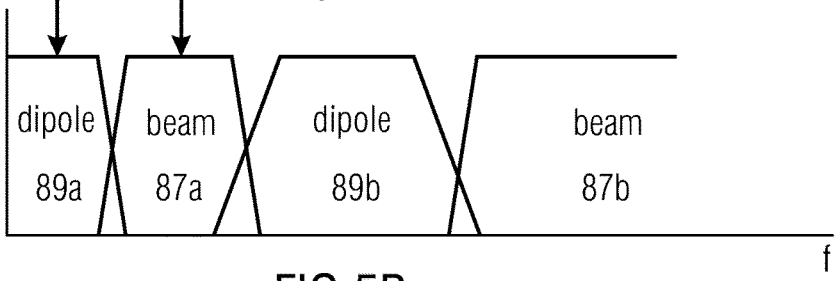

Another advantageous embodiment is illustrated by FIGS. 5*a* and 5*b*, wherein the FIG. 5*a* shows the sound system 102 comprising the soundbar 20 and two additional separately enclosed loudspeakers 29*a* and 29*b*.

FIG. 5*b* illustrates the corresponding frequency diagram illustrating the signal portions of the entire frequency range assigned to the group of transducers of the sound system 102. Such a system 102 of FIG. 5*a* may advantageously be used in combination with a television set. While the middle array 20, which can be used for beamforming, is centered with respect to the screen (not shown). The detached side enclosures 29*a* and 29*b* can be positioned in the corners of the screen. Such, the maximum meaningful extent (the TV) is used in its entirety. The described concept is flexible enough to make best possible use of the actual spacing. Such, the driver arrangement of the sound system 102 is flexible with regard to different screen sizes while the underlying processing is basically the same. Information about this absolute position can, for example, be gained from setup information that is transmitted from the TV, e.g., via HDMI.EDID, from user input or is known if the loudspeakers are integrated into the TV set.

As illustrated by FIG. 5*b*, the entire frequency range may be divided into four portions marked by the reference numerals 89*a*, 87*a*, 89*b* and 87*b*. The two portions 89*a* and 89*b* comprising low frequencies and medium frequencies are reproduced using dipoling with the separate transducers 29*a* and 29*b* as marked by the group 89*a*/89*b*. The second portions 87*a* and 87*b* comprise a frequency range 87*a* arranged between the two frequency ranges 89*a* and 89*b* and a frequency range 87*b* comprising just high frequencies. These two frequency bands 87*a* and 87*b* are reproduced using beamforming, wherein all transducers of the array 20 as well as the transducers 29*a* and 29*b* operate.

Figure 5C:
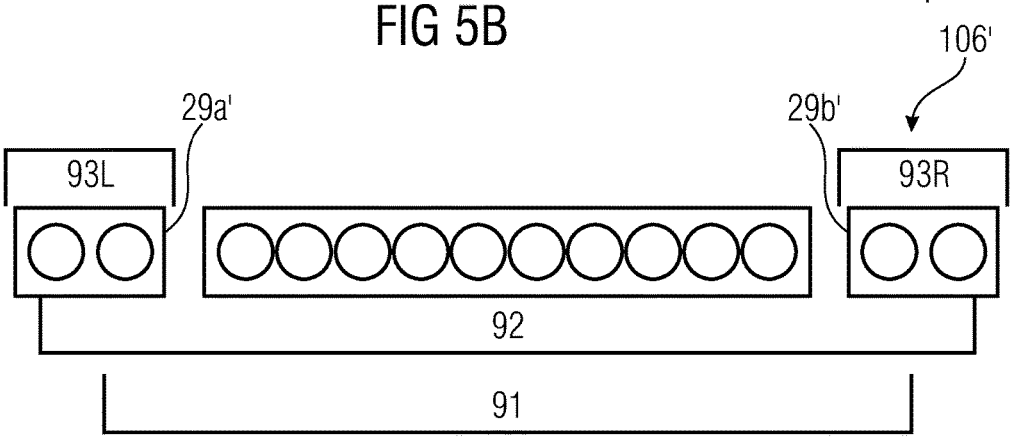
FIGS. 5*c*, 5*d* illustrate an embodiment of an array comprising separate enclosed loudspeakers using side-orientated dipoles.
Figure 5D:
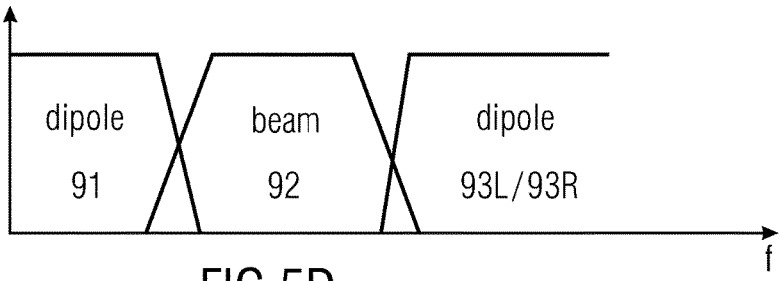

FIGS. 5*c* and 5*d* illustrate another refinement of the aforementioned embodiment. FIG. 5*c* illustrates the soundbar setup 104, wherein FIG. 5*d* illustrates the corresponding frequency diagram.

The sound setup 104 comprises two separate enclosures 29*a*' and 29*b*' and the array 20. The separate enclosures 29*a* and 29*b* differ from the enclosures 29*a* and 29*b* in such a way that same comprise two transducers in order to enable dipoling having a first order. Alternatively, the two separate loudspeaker elements 29*a*' and 29*b*' may be configured to perform dipoling having a second or higher order, wherein the sound reproduction/dipoling having a second or higher order typically uses three or more transducers. I.e., according to further embodiments, the soundbar setup 104 may comprise two separate enclosures 29*a*' and 29*b*', each comprising at least three transducers.

An exemplary grouping of the sound system 104 will be discussed below. For example, the two separate enclosures 29*a*' and 29*b*' may be grouped to the group 91 performing dipoling in a low frequency band, wherein each enclosure 29*a*' and 29*b*' forms their own dipole (cf. 93*l* and 93*r*). The array 20 is grouped to the group 92 which is reproduced by performing beamforming within the frequency portion 92 arranged between the frequency portions 91 and 93*l*/93*r*. An advantage is that the dipole processing can be used to enhance the playback performance. To achieve this (independently of the screen size) at least a pair of closely spaced loudspeakers, namely the two closely spaced drivers 29*a*' and 29*b*' are positioned in each corner. Such, for frequencies that are too high to be beamformed, the sided dipoles can reproduce the high frequencies and steer a null towards the listener in order to generate a local sound minimum. Even though there might still be aliasing artifacts, the general direction of the high frequency content corresponds to the direction of the corresponding beam 92 (i.e., beam towards the left, left dipole for higher frequencies; same for right).

The described method cannot only be used for horizontal playback but also to reproduce vertically spatially spread sounds. For this, the loudspeaker array would have to be arranged vertically as illustrated by FIG. 7.

Figure 7:
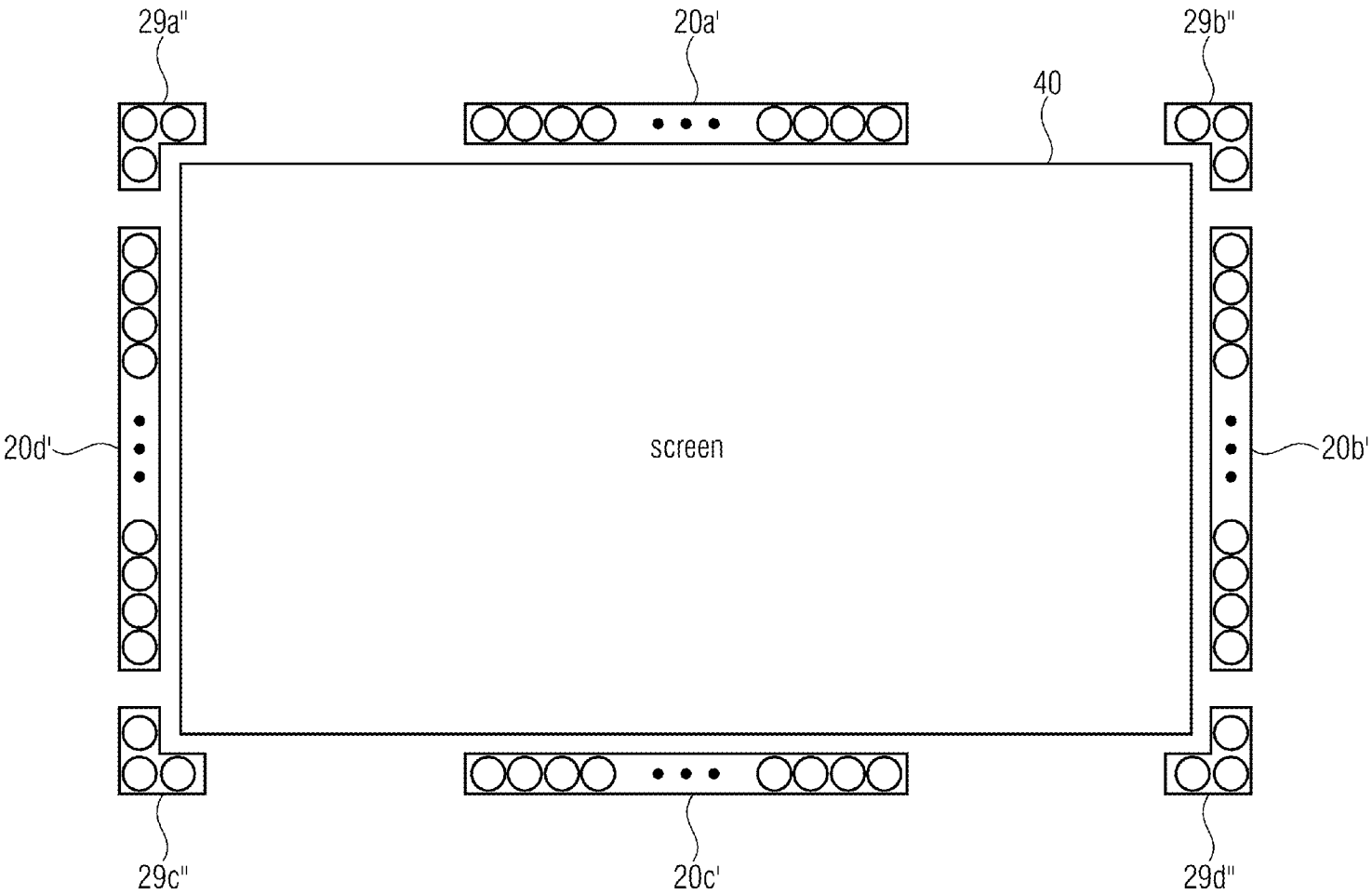
FIG. 7 shows a schematic arrangement of loudspeakers around a screen.

FIG. 7 illustrates further aspects according to which edge loudspeakers 29*a*" to 29*d*" as corner-enclosures are combined with vertically and horizontally placed arrays 20*a*' to 20*d*'. In addition to the described processing, the loudspeakers 29*a*" to 29*d*" at the edges of the television 40 can advantageously be used as corner loudspeakers for a panning system. As can be seen, the corner loudspeakers 29*a*" to 29*d*" are formed as single arrays 29*a*" to 29*d*" each comprising at least three transducers being arranged on a flexed line, e.g. having an angle of 90°. Such corner loudspeakers 29*a*" to 29*d*" form a two-dimensional array enabling to perform vertical and horizontal beamforming or dipoling (wherein just three transducers are needed). Furthermore, the flexed arrangement enables optimal positioning the corner loudspeakers 29*a*" to 29*d*" at the corners of the display 40. The corner loudspeakers 29*a*" to 29*d*" may be described in other words as speaker having at least three transducers, wherein the three transducers are arranged as corner element such that two transducers of the three transducers are positioned vertically and two transducers of the three transducers are positioned horizontally. In general, the system of FIG. 7 comprising at least four loudspeakers in the corners of a display 40 serves the purpose to render sound on screen, at the same position as an accompanying picture.

It should be noted that one or more of the abovementioned corner loudspeakers 29*a*" to 29*d*" (stand-alone) form, according to embodiments, a sound system which can be used in combination with the above calculation unit to perform vertical and horizontal beamforming or dipoling.

Figure 6A:
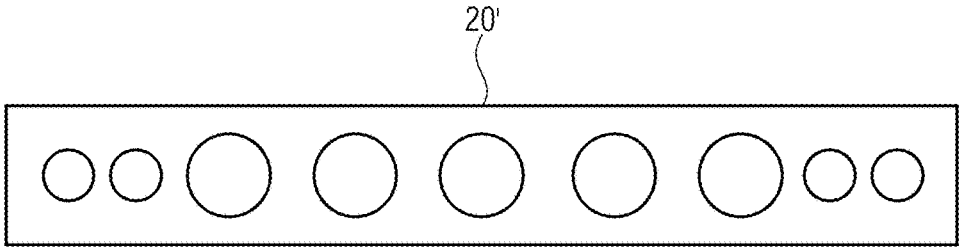
FIG. 6*a* shows an embodiment of an array comprising transducers of different sizes.
Figure 6B:
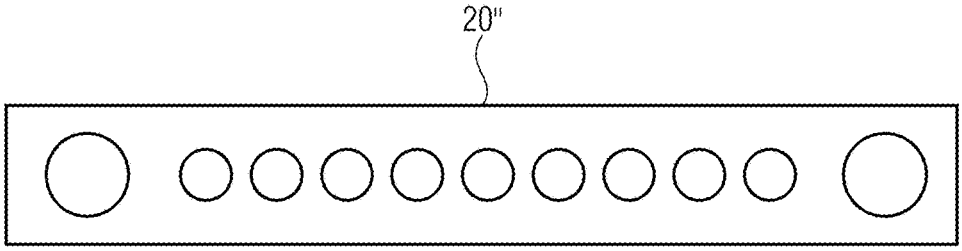
FIG. 6*b* shows an embodiment of an array comprising transducers of different sizes.

Within above embodiments, although the arrays are discussed in context of arrays having similar transducers, it should be noted that also arrays having transducers of a different type, e.g., of a different size may be used as illustrated by FIGS. 6*a* and 6*b*.

FIG. 6*a* shows an array 20' comprising nine transducers, wherein the two outermost transducers of a first side and the two outermost transducers of a second side are smaller when compared to the transducers in the middle. Such an array 20' may be used as a variation of the system 104 in which a number of transducers of larger size are used to reproduce audio via beamforming, wherein the array extends with two pairs of transducers of smaller size which create side dipoles for a higher frequency content. As illustrated by FIG. 6*a*, this setup may be implemented into one single element.

FIG. 6*b* shows a variation of the array 20', namely the array 20" which uses an array of smaller size transducers flanked by a pair of larger size transducers.

The two arrays 20' and 20" or variations thereof may be used as arrays for the above embodiments. In above embodiments, it has advantageously been explained that beamforming within a certain frequency range may be combined with dipoling in order to reproduce the "problematic" frequency bands more expedient.

The reproduction of the "problematic" frequency range, as discussed in context of FIG. 1, may be reproduced using beamforming in case the beamforming in the problematic frequency range is manipulated or corrected by use of another beamforming reproduction such that the entire result of the sound reproduction is comparable with the combination of beamforming and dipoling with regard to its reproduction quality. This second technique comprising beamforming in combination with sound cancelation will be discussed in detail below.

Figure 8:
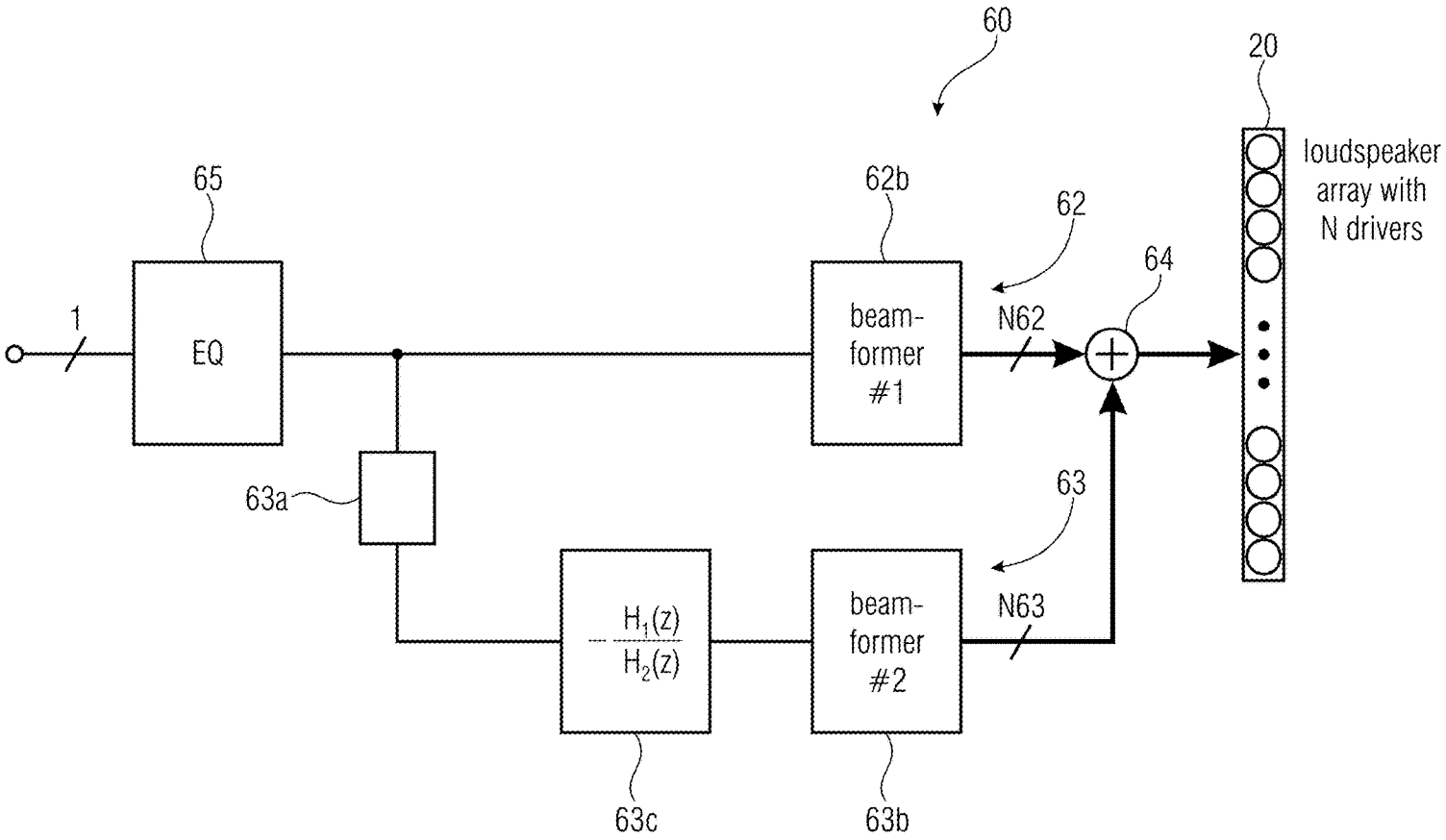
FIG. 8 shows a schematic block diagram of a calculation unit for a sound system enabling beamforming with sound cancelation.

For this technique a calculation unit 60 may be used, as illustrated by FIG. 8. FIG. 8 shows an exemplary block diagram of a calculation unit 60 for processing the sound cancelation. The calculation unit 60 comprises two processing paths 62 and 63 and an optional equalizer 65 at the input. In the processing paths 62 and 63 the different frequency bands are processed separately. Here, the process path 62 used for calculating the first plurality of signals N62 (for the first beamforming reproduction) process the entire frequency band of the input stream using the beamformer 62*b*. In contrast, the path 63 used for the sound cancelation processes just a limited portion of the entire frequency band. Therefore path 63 comprises the filter 63*a*, arranged between the optional EQ 65 and the second beamformer 63*b* of path 63. Furthermore, 63 comprises an inversion-filter 63*c* ($-H_1(z)/H_2(z)$) arranged at the input of the beamformer 63*b* performing an inversion of the input signals such that the audio signals plurality N63 output by the beamformer 63*b* enable the direct sound suppression within the limited portion of the entire frequency band. The beamformer 63*b* outputs the second plurality of signals N63. The first plurality of audio signals N62 and the second plurality of audio signals plurality N63 are added using the mixer 64 and output to the array. Typically the mixer 64 is integrated into the output means of the calculation unit 60.

Figure 9A:
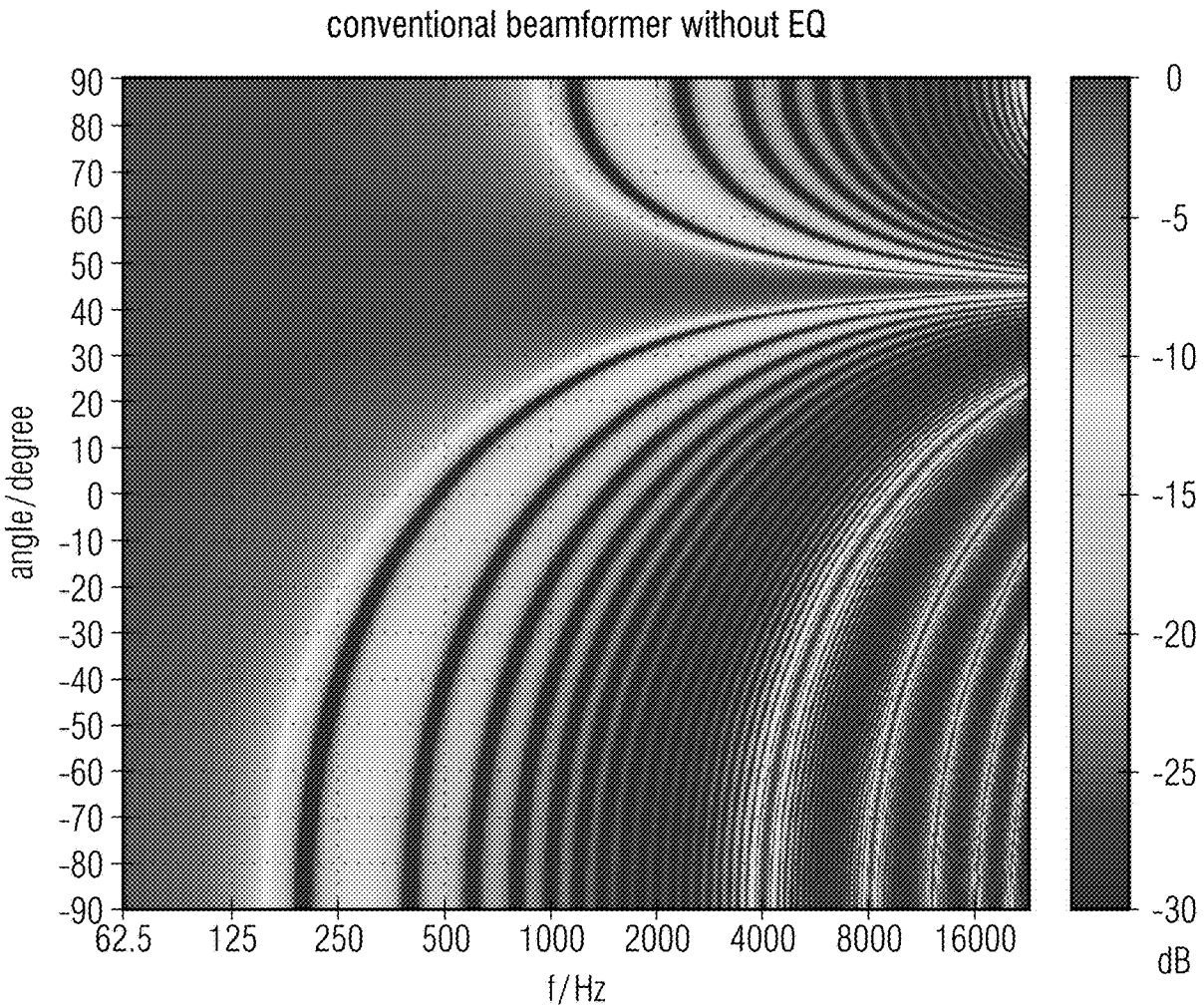
FIGS. 9*a* to 9*c* show schematic diagrams illustrating the directivity of a beamformer wherein beamforming is performed using different soundbar control methods.

The concept of sound cancelation will be discussed with respect to FIGS. 9*a* to 9*c*. FIG. 9*a* shows a directivity in dB of a (first) beamformer. This first beamforming may be reproduced using 20 equal distant drivers in 5 cm distance. A steering angle of 45° should be reproduced. As can be seen, this beamformer alone has an insufficient directivity at low frequencies, e.g., sound below 300 Hz or 400 Hz. Consequently, a listener sitting in front of the soundbar at 0° will localize sound below 300 Hz or 400 Hz at 0°, the direction of the soundbar. This insufficient directivity at the portion of the entire frequency range below 300 or 400 Hz may be corrected by using sound cancelation due to which a sound cancellation in this frequency portion and in the defective angle range may be performed. Consequently, the sound that reaches the listeners directly from the loudspeaker array in this portion is reduced by means of sound cancellation as illustrated by FIG. 9*b*.

Figure 9B:
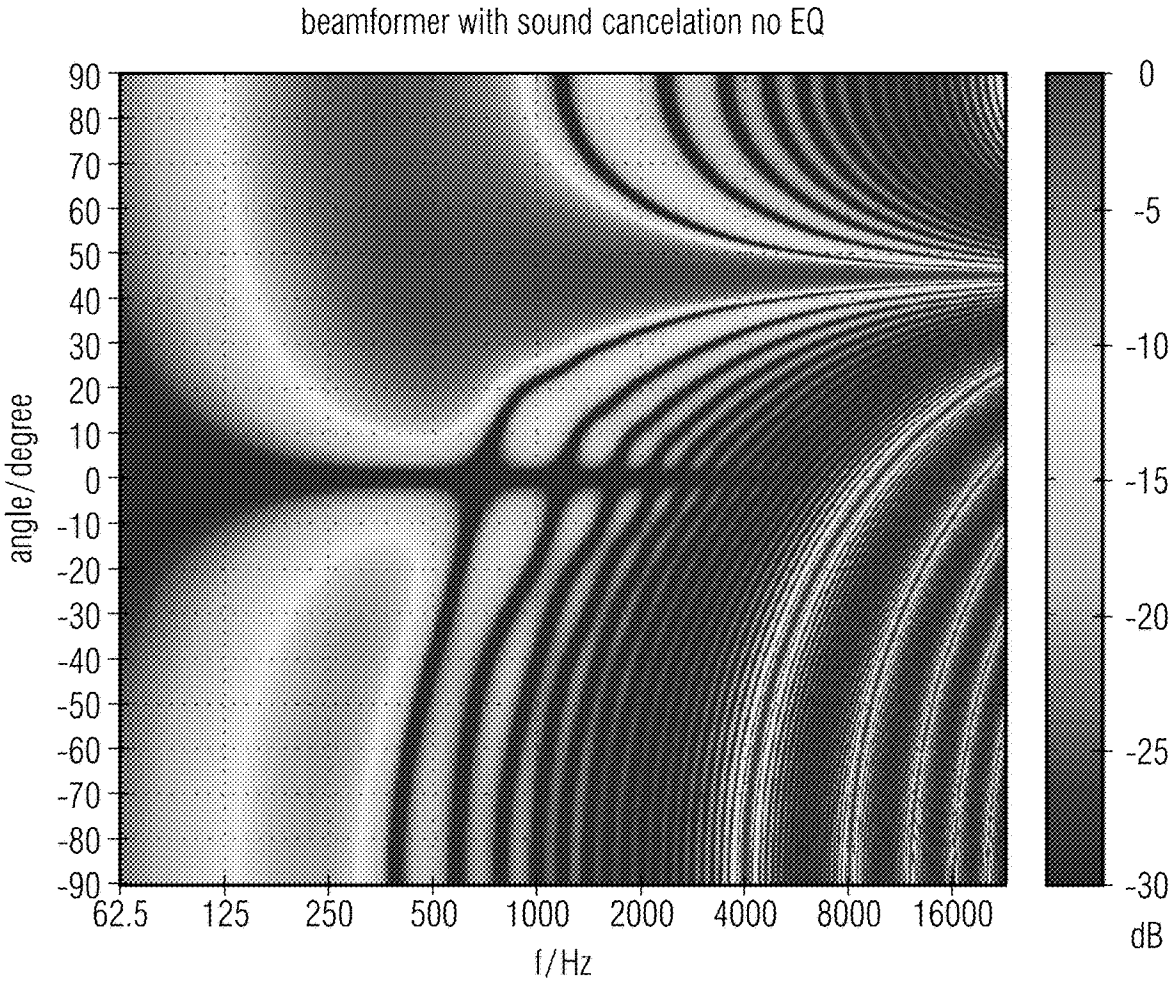
Figure 9C:
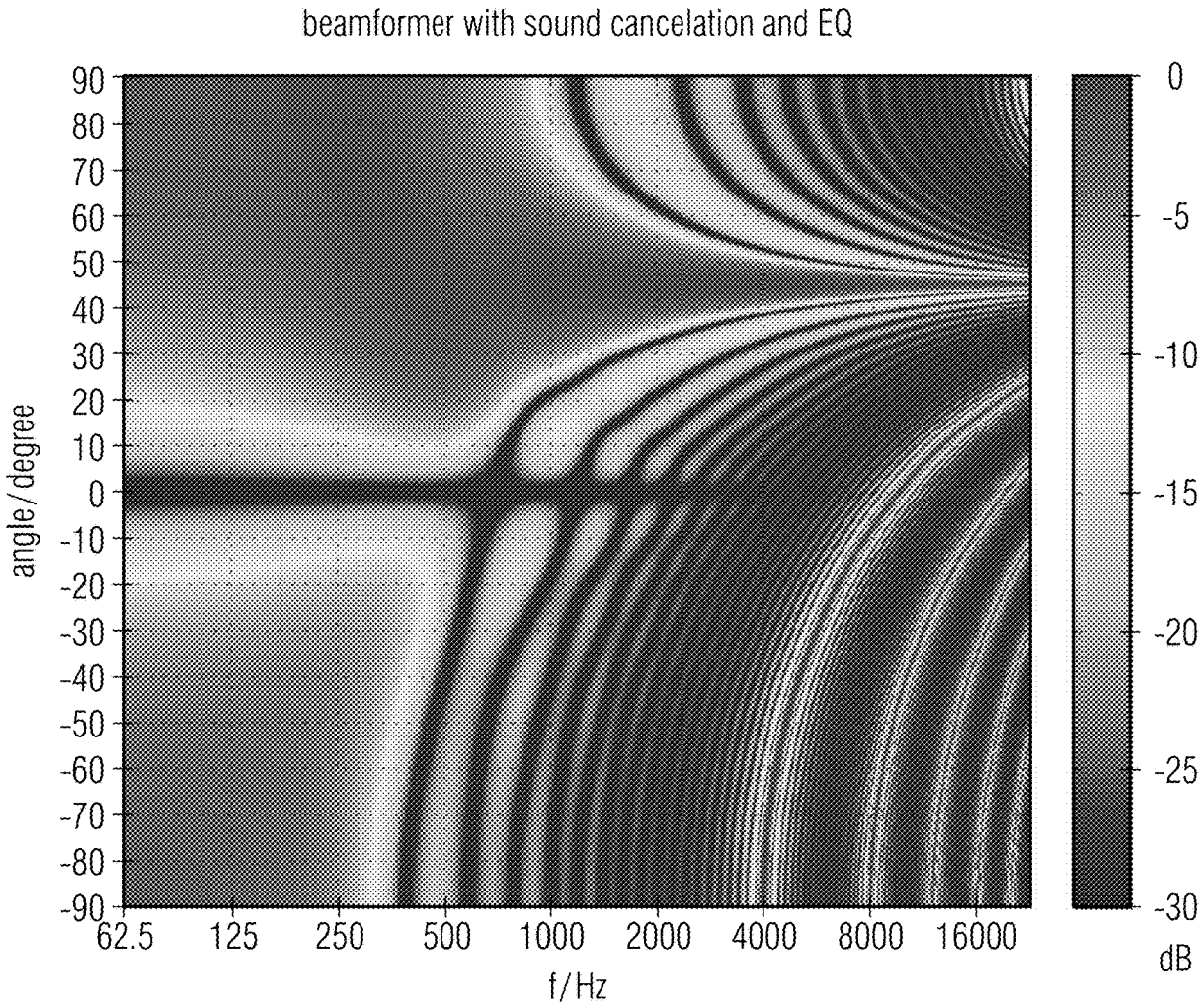

FIG. 9*b* shows a directivity in dB of the beamformer, wherein a second beam within the problematic frequency range has been applied in order to cancel the unwanted directed sound of the first beam. The application of sound cancelation may lead to a directivity pattern having a minimum at low frequencies within the range of 30 to −30°.

This result, as illustrated by FIG. 9*b*, may be further improved by means of an equalizer in order to compensate the loss at low frequencies. Therefore, the processor discussed with respect to FIG. 1 may further comprise an equalizer configured to perform an equalization within the second portion. The result of the equalization is illustrated by FIG. 9*c*. As can be seen, the directivity pattern within the low frequencies has a sharp notch at 0°. It should be noted that principle of sound cancelation and dipoling may be combined.

According to further embodiments, the lowpass channel may be supported by using a subwoofer. For such an use case, the processor may be configured to forward directly a signal received via the input means to the output means with or without filtering the signal. Note that this direct forwarding is not limited to single channels or certain frequency bands.

Although in the above embodiments the sound system has been described as a system comprising at least a soundbar, it should be noted that the system may also be formed by another type of array, e.g. an array comprising two or three separated transducers.

Although in the above embodiments the invention has been discussed in context of an apparatus, it should be noted that a further embodiment refers to a method for calculating a sound reproduction for a sound system. The method comprises the steps of receiving an audio stream to be reproduced using the array and having a frequency range; calculating a first plurality of individual audio signals for the transducers such that beamforming is performed; calculating a second plurality of individual audio signals for the transducers of the sound system such that sound cancelation and/or dipoling is performed and filtering the first plurality of individual audio signals using a first bandpass characteristic comprising a first portion of the frequency range of the audio stream; filtering the second plurality of individual audio signals using a second passband characteristic comprising a second portion of the frequency range of the audio stream, wherein the second portion differs from the first portion; and outputting the individual audio signals of the first and second plurality in order to control the sound system.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A calculation unit for a sound system comprising an array including a plurality of transducers, the calculation unit comprising:

an input terminal for receiving an audio stream to be reproduced using the sound system and including a frequency range;

a processor; and an output terminal for controlling the sound system, wherein the processor is configured to calculate a first plurality of individual audio signals for the transducers of the array such that beamforming is performed by the array, wherein the first plurality of individual audio signals comprises a frequency range corresponding to a first portion of the frequency range of the audio stream, wherein the processor is configured to calculate a second plurality of individual audio signals for the transducers of the sound system to perform, using the sound system, direct sound suppression such that sound is canceled towards a listening direction, wherein the processor is configured to filter the second plurality of individual audio signals using a second passband characteristic comprising a second portion of the frequency range of the audio stream, wherein the second portion differs from the first portion;

wherein the beamforming performed via the first plurality of individual audio signals is performed by using at least three audio signals such that at least three transducers are controlled;

wherein the first plurality of audio signals and the second plurality of audio signals are added using the mixer to be output to the one array comprising the transducers of the sound system which are controlled by the first and the second plurality of individual audio signals.

2. The calculation unit according to claim 1, wherein the direct sound suppression is performed using sound cancelation and/or dipoling.

3. The calculation unit according to claim 2, wherein the sound cancelation comprises a manipulation of the beamforming within the second portion of the frequency range of the audio stream.

4. The calculation unit according to claim 2, wherein the sound cancelation corrects the beamforming performed via the first plurality of individual audio signals within the second portion of the frequency range.

5. The calculation unit according to claim 1, wherein second portion is a subset of the first portion.

6. The calculation unit according to claim 1, wherein the processor is configured to filter the first plurality of individual audio signals using a first passband characteristic comprising the first portion of the frequency range of the audio stream.

7. The calculation unit according to claim 2, wherein the direct sound suppression is performed using dipoling which is performed by providing at least two individual audio signals of the second plurality of individual audio signals for two different transducers in a phase-shifted manner or by providing at least two groups of individual audio signals of the second plurality of individual audio signals for two groups of different transducers in a phase-shifted manner.

8. The calculation unit according to claim 7, wherein the two individual audio signals or the two groups of individual audio signals are phase-shifted by 180°.

9. The calculation unit according to claim 1, wherein the second portion of the frequency range is lower than the first portion of the frequency range.

10. The calculation unit according to claim 1, wherein the beamforming performed via the second plurality of individual audio signals is performed by using at least three audio signals such that at least three transducers are controlled.

11. The calculation unit according to claim 1, wherein different transducers are controlled via the first plurality of individual audio signals and via the second plurality of individual audio signals.

12. The calculation unit according to claim 1, wherein all transducers of the array are controlled via the first plurality of individual audio signals and wherein a subset of transducers of the sound system is controlled via the second plurality of individual audio signals.

13. The calculation unit according to claim 1, wherein the processor is configured to calculate a third plurality of individual audio signals for the transducers of the sound system such that dipoling is performed by the sound system and wherein the processor is configured to filter the third plurality of individual audio signals using a third passband characteristic comprising a third portion of the frequency range of the audio stream, wherein the third portion differs from the first portion and the second portion.

14. The calculation unit according to claim 1, wherein the processor is configured to calculate a third plurality of individual audio signals for the transducers of the sound system comprising a stereophonic reproduction, wherein the processor is configured to filter the third plurality of individual audio signals using a third passband characteristic comprising a third portion of the frequency range of the audio stream, wherein the third portion of the frequency range differs from the first and second portion of the frequency range.

15. The calculation unit according to claim 1, wherein transducers of the sound system which are arranged furthest of each other are controlled via the second plurality of individual audio signals or wherein transducers of the sound system which are arranged furthest of each other are controlled via the third plurality of individual audio signals.

16. The calculation unit according to claim 1, wherein the processor calculates the first plurality of individual audio signals $x_i$ based on the formula $$x_i(t)=HPF\{s(t+\tau_i)\},$$

wherein HPF complies with the first passband characteristic and $\tau_i$ with a steering delay of transducers of the array, and wherein the processor calculates the second plurality of individual audio signals $x_1$ and $x_n$ based on the formula $$x_1(t)=LPF\{s(t)\}$$

$$x_N(t)=-LPF\{s(t)\},$$

wherein LPF complies with the second passband characteristic.

17. A sound system comprising:

the processor according to claim 1 and an array including the plurality of transducers.

18. The system according to claim 17, further comprising at least two additional separated loudspeaker elements.

19. The system according to claim 18, wherein each of the two separated loudspeaker elements comprises an array including at least three transducers being arranged on a flexed line.

20. A method for calculating a sound reproduction for a sound system comprising an array including a plurality of transducers, the method comprising:

receiving an audio stream to be reproduced using the array and including a frequency range;

calculating a first plurality of individual audio signals for the transducers of the array such that beamforming is performed via the array, wherein the first plurality of individual audio signals comprises a frequency range corresponding to a first portion of the frequency range of the audio stream;

calculating a second plurality of individual audio signals for the transducers of the sound system to perform, using the sound system, direct sound suppression such that sound is canceled towards a listening direction;

filtering the second plurality of individual audio signals using a second passband characteristic comprising a second portion of the frequency range of the audio stream, wherein the second portion differs from the first portion;

outputting the individual audio signals of the first and second plurality in order to control the sound system; and adding the first plurality of audio signals and the second plurality of audio signals using the mixer to be output to the one array comprising the transducers of the sound system which are controlled by the first and the second plurality of individual audio signals.

21. A non-transitory digital storage medium having a computer program stored thereon to perform the method for calculating a sound reproduction for a sound system comprising an array including a plurality of transducers, said method comprising:

receiving an audio stream to be reproduced using the array and including a frequency range;

calculating a first plurality of individual audio signals for the transducers of the array such that beamforming is performed via the array, wherein the first plurality of individual audio signals comprises a frequency range corresponding to a first portion of the frequency range of the audio stream;

calculating a second plurality of individual audio signals for the transducers of the sound system to perform, using the sound system, direct sound suppression such that sound is canceled towards a listening direction;

filtering the second plurality of individual audio signals using a second passband characteristic comprising a second portion of the frequency range of the audio stream, wherein the second portion differs from the first portion;

outputting the individual audio signals of the first and second plurality in order to control the sound system; and adding the first plurality of audio signals and the second plurality of audio signals using the mixer to be output to the one array comprising the transducers of the sound system which are controlled by the first and the second plurality of individual audio signals;

when said computer program is run by a computer.

22. A calculation unit for a sound system comprising an array including a plurality of transducers, the calculation unit comprising:

an input terminal for receiving an audio stream to be reproduced using the sound system and including a frequency range;

a processor; and an output terminal for controlling the sound system, wherein the processor is configured to calculate a first plurality of individual audio signals for the transducers of the array such that beamforming is performed by the array, wherein the first plurality of individual audio signals comprises a frequency range corresponding to a first portion of the frequency range of the audio stream, wherein the processor is configured to calculate a second plurality of individual audio signals for the transducers of the sound system to perform, using the sound system, direct sound suppression such that sound is canceled towards a listening direction, wherein the processor is configured to filter the second plurality of individual audio signals using a second passband characteristic comprising a second portion of the frequency range of the audio stream, wherein the second portion differs from the first portion;

wherein the direct sound suppression is performed using sound cancelation, wherein the sound cancelation corrects second plurality of individual audio signals within the second portion of the frequency range using beamforming performed via the first plurality of individual audio signals;

wherein the first plurality of audio signals and the second plurality of audio signals are added using the mixer to be output to the one array comprising the transducers of the sound system which are controlled by the first and the second plurality of individual audio signals.

23. A calculation unit for a sound system comprising an array including a plurality of transducers, the calculation unit comprising:

an input terminal for receiving an audio stream to be reproduced using the sound system and including a frequency range;

a processor; and an output terminal for controlling the sound system, wherein the processor is configured to calculate a first plurality of individual audio signals for the transducers of the array such that beamforming is performed by the array, wherein the first plurality of individual audio signals comprises a frequency range corresponding to a first portion of the frequency range of the audio stream, wherein the processor is configured to calculate a second plurality of individual audio signals for the transducers of the sound system to perform, using the sound system, direct sound suppression such that sound is canceled towards a listening direction, wherein the processor is configured to filter the second plurality of individual audio signals using a second passband characteristic comprising a second portion of the frequency range of the audio stream, wherein the second portion differs from the first portion;

wherein the beamforming performed via the first plurality of individual audio signals is performed by using at least three audio signals such that at least three transducers are controlled, wherein second portion is a subset of the first portion;

wherein the first plurality of audio signals and the second plurality of audio signals are added using the mixer to be output to the one array comprising the transducers of the sound system which are controlled by the first and the second plurality of individual audio signals.

* * * * *